United States Patent [19]

Fujimoto et al.

[11] Patent Number: 4,981,379

[45] Date of Patent: Jan. 1, 1991

[54] PRINT RIBBON GUIDE

[75] Inventors: Tadashi Fujimoto; Norio Suzuki, both of Tokyo, Japan

[73] Assignee: Juki Corporation, Tokyo, Japan

[21] Appl. No.: 283,724

[22] Filed: Dec. 13, 1988

[30] Foreign Application Priority Data

Dec. 25, 1987 [JP] Japan ..... 62-329314

[51] Int. Cl.[5] ..... B41J 35/06

[52] U.S. Cl. ..... 400/248

[58] Field of Search ..... 400/211, 213.1, 247, 400/248, 248.3, 215, 215.1, 215.2, 215.3, 215.4, 216, 216.1, 216.2, 216.3, 216.4, 216.5, 216.6; 101/336; 225/196, 197; 242/76

[56] References Cited

U.S. PATENT DOCUMENTS

| | | | |
|---|---|---|---|
| 4,110,050 | 8/1978 | Wood et al. | 400/248 |
| 4,229,112 | 10/1980 | Schaefer | 400/248 |
| 4,272,201 | 6/1981 | Steger | 400/248 |
| 4,335,857 | 6/1982 | Pfost et al. | 226/196 |
| 4,413,920 | 11/1983 | Matthias et al. | 400/248 |
| 4,867,589 | 9/1989 | Limberger et al. | 400/248 |

FOREIGN PATENT DOCUMENTS

| | | | |
|---|---|---|---|
| 189975 | 8/1986 | Japan | 400/248 |

OTHER PUBLICATIONS

W. P. Bakken; "Helically Grooved Ribbon Guide", *IBM Technical Disclosure Bulletin;* vol. 13, No. 8, p. 2229; Jan. 1971.

*Primary Examiner*—David A. Wiecking

*Attorney, Agent, or Firm*—Fitch, Even, Tabin & Flannery

[57] ABSTRACT

A type writing ribbon guide device in a type writing appliance which comprises a pair of inner ribbon guides disposed adjacent to the type writing zone in the appliance and a pair of outer ribbon guides positioned outwardly from the inner ribbon guides and in which a type writing ribbon presents concave and convex curved shapes having different radius of curvature as the ribbon is guided along the outer and inner ribbon guides.

6 Claims, 2 Drawing Sheets

PRINT RIBBON GUIDE

BACKGROUND OF THE INVENTION

This invention relates to a type writing ribbon guide device to be disposed at an area in the vicinity of the type writing head in a type writing appliance.

PRIOR ART

In the prior art type writing appliance as shown in FIG. 10, the type writing head 1 positioned in the type writing zone strikes against the type write ribbon 2 being fed below the head to type-write letters and the like on a sheet of paper (not shown) through the ribbon mask 3.

The type writing ribbon 2 is guided along a pair of inner ribbon guides 4 positioned in opposing and spaced relationship adjacent to the type writing head 1, a pair of outer ribbon guides 5 positioned outwardly from, respectively, of the respective inner ribbon guides 4 while running through the appliance.

When the type writing ribbon 2 now being employed is to be replaced by a ribbon having a color different from the color of the ribbon being employed, the ribbon being employed is shifted in the transverse direction of the ribbon. Thus, in order that the ribbon can be easily shifted in the transverse direction thereof, the undersurface of the inner ribbon guide 4 which contacts the ribbon is formed concave having the radius of curvature R as seen from the head 1 side in the transverse direction of the ribbon 2 as shown in FIG. 11.

Since the undersurface of the inner ribbon guide 4 is formed concave in the transverse direction of the ribbon as described hereinabove, when a portion of the running type writing ribbon 2 is positioned between the inner ribbon guides 4, 4, that is, at the type writing zone, the ribbon 2 presents the concave shape in the transverse direction thereof as seen from the head 1 side as shown by reference numeral *2a* in FIG. 12.

However, since the type writing ribbon 2 is directed from either one outer ribbon guide 5 to the adjacent inner ribbon guide 4, the ribbon 2 is bent over the outer ribbon guide 5. Thus, in the prior art ribbon guide device, the ribbon bending portion of the outer ribbon guides 5 are formed linear. As a result, the ribbon 2 also presents a linear shape when the ribbon 2 is guided along the bending portions on the outer ribbon guides 5 as shown by reference numeral *2b* in FIG. 12.

Therefore, as the type writing ribbon 2 passes between either one inner ribbon guide 4 and the adjacent outer ribbon guide 5, the ribbon forms the portion as shown by reference numeral *2c* in FIG. 12 in which the area adjacent to the longitudinal center line of the ribbon is pulled with a force higher than that pulling the opposite side edges of the portion to thereby form the slack ripples or creases at the opposite side edges as shown by reference numeral *2d* in FIG. 12.

Therefore, the prior art presents the problem that the feed and/or transverse shift of the type writing ribbon encounter difficulties resulting in low quality of type writing.

SUMMARY OF THE INVENTION

In order to overcome the above-mentioned problem, the present invention provides a novel and improved type writing ribbon guide device positioned at an area in the vicinity of the type writing head in a type writing appliance. The improved ribbon guide device comprises a pair of opposing and spaced inner ribbon guides positioned adjacent to the type writing head and a pair of outer ribbon guides each positioned outwardly from the respective inner ribbon guide. Each inner ribbon guide has a ribbon bending area on the ribbon guide face thereof for directing the type writing ribbon towards the type writing zone below the type writing head and each outer ribbon guide has a ribbon bending area on the ribbon guide face thereof for directing the ribbon towards the adjacent inner ribbon guide. In operation of the type writing appliance, the running type writing ribbon presents in a position inwardly from the ribbon bending areas of the guides or at the type writing zone the concave shape having the radius of curvature R1 as seen from the type writing head side, in a position outwardly from the bending area of each outer ribbon guide the concave shape having the radius of curvature R2 slightly smaller than R1 as seen from the type writing head and the convex shape having the radius of curvature R3 varying continuously from R1 and R2 as seen from the printing head side between the bending area on each inner ribbon guide and the bending area of the adjacent outer ribbon guide.

According to the ribbon guide device of the present invention described hereinabove, in the position between the respective adjacent inner and outer ribbon guides the ribbon is pulled at the oppposite side edges with a force higher than that with which the area between the opposite side edges is pulled whereby there is no possibility of occurence of a crease on the ribbon.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

Figure 1:
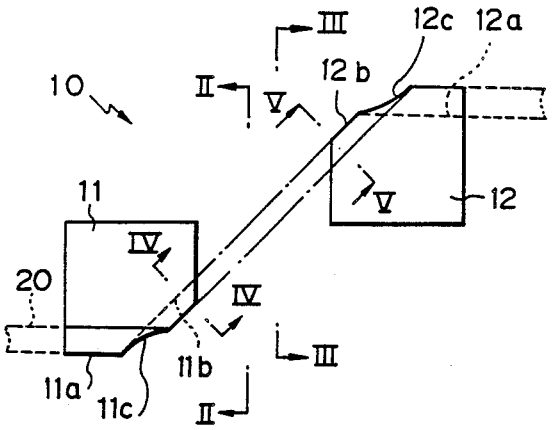
FIG. 1 is a front elevational view of the type writing ribbon guide device embodying the present invention.
Figure 2:
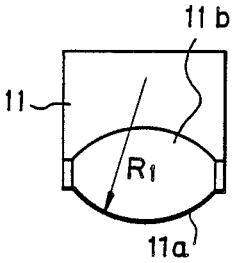
FIG. 2 is a sectional view of the inner ribbon guide taken along the line II—II and as seen in the arrow direction of FIG. 1.
Figure 3:
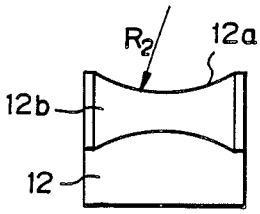
FIG. 3 is a sectional view of the outer ribbon guide taken along the line III—III and as seen in the arrow direction of FIG. 1.
Figure 4:
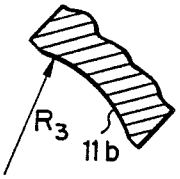
FIG. 4 is a sectional view taken along the line IV—IV of FIG. 1.
Figure 5:
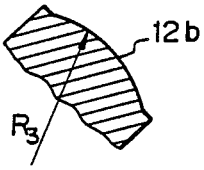
FIG. 5 is a sectional view taken along the line V—V of FIG. 1.
Figure 6:
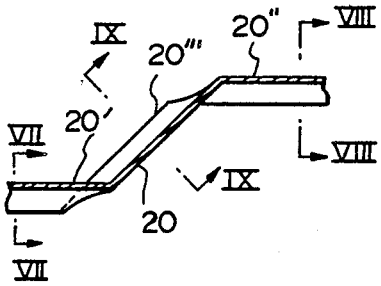
FIG. 6 is a side view of a type writing ribbon to be guided by the guide device of the present invention.
Figure 7:
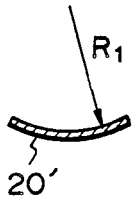
FIGS. 7, 8 and 9 are sectional views taken along the lines VII, VIII and IX, respectively, of FIG. 1.
Figure 8:
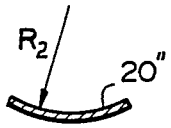

The present invention will be now described referring to FIGS. 1 to 9 inclusive in which the preferred embodiment of the invention is shown for illustration purpose only.

FIGS. 1 to 5 inclusive show the inner ribbon guide 11 and outer ribbon guide 12 of the type writing ribbon guide device according to the present invention.

Although only one of the inner ribbon guides 11 and only one of the outer ribbon guides 12, are shown respectively, as in the case of the prior art ribbon guide device in which two inner ribbon guides 4, 4 and two outer ribbon guides 5, 5 are provided in symmetrical relationship, respectively, two inner ribbon guides 11 and two outer ribbon guides 12 can be provided in symmetrical relationship with respect to the type writing head in the ribbon guide device of the present invention.

The inner ribbon guide 11 has a convex ribbon guide face 11*a* having the radius of curvature R1 and a concave ribbon guide face 11*b* having the radius of curvature R2 of which description will be made hereinafter. Provided between the convex and concave guide faces 11*a*, 11*b* is a ribbon bending area 11*c* where a ribbon 20 is bent.

Similarily, the outer ribbon guide 12 has a concave ribbon guide face 12*a* having the radius of curvature R2 slightly smaller than the radius of curvature R1 and a convex ribbon guide face 12*b* having the radius of curvature R3. Provided between the guide faces 12*a*, 12*b* is a ribbon bending area 12*c* where the ribbon 20 is bent.

Needless to say, the ribbon guide faces 11*a*, 11*b*, 12*a*, 12*b* lie in the same one plane containing the type writing head 1 and the concave face of the ribbon guide face 11*b* and convex guide face 12*b* are positioned so as to complement each other.

The radius of curvature R3 of the guide faces 11*b*, 12*b* varies continuously from the radius of curvature R1 at the bending area 11*c* to the radius of curvature R2 at the bending area 12*c*.

With the above-mentioned construction and arrangement of the components of the ribbon guide device of the present invention, as shown in FIGS. 6 to 9 inclusive in the operation of the type writing appliance, the type writing ribbon 20 to be guided along the inner ribbon guides 11 and outer ribbon guides 12 presents the concave shape having the radius of curvature R1 seen from the type writing head side as shown by reference numeral 20' (see the cross-sectional view of FIG. 7) between the inner guide 11, 11, the concave shape having the radius of curvature R2 slightly smaller than the radius of curvature R1 seen from the head side as shown by reference numeral 20'' (see the cross-sectional view of FIG. 8) at an area positioned outwardly from the ribbon bending area 12*c* of the outer ribbon guide 12 and the convex shape having the radius of curvature R3 varying continuously from the radius of curvature R1 to R2 as seen from the type writing head side as shown by reference numeral 20''' (see the cross-sectional view of FIG. 9) between the bending area 11*c* of the inner guide 11 and the bending area 12*c* of the outer guide 12.

Figure 9:
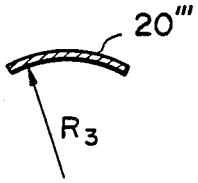
Figure 10:
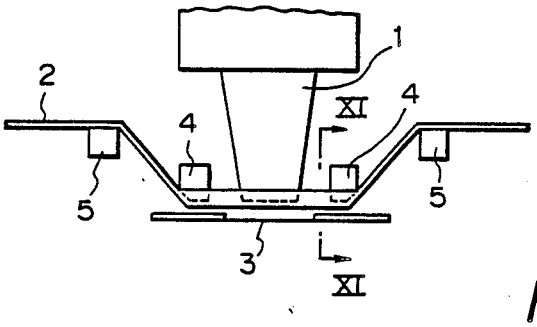
FIG. 10 is a front elevational view of a prior art type writing ribbon guide device seen at an area in the vicinity of the type writing zone in a prior art type writing appliance.
Figure 11:
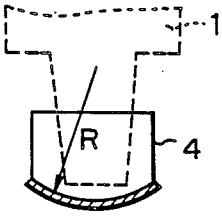
FIG. 11 is a side sectional view of the inner ribbon guide in the prior art type writing ribbon guide device taken along the line XI—XI of FIG. 10.
Figure 12:
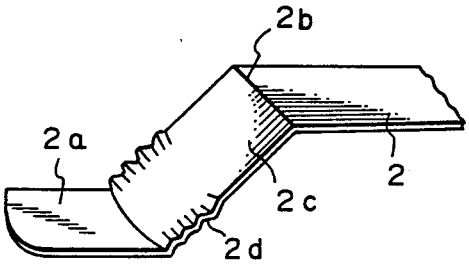
FIG. 12 is a perspective-view showing the occurence of creases on the side edges of a type writing ribbon being guided by the prior art ribbon guide device shown in FIG. 10.

In the convex curve 20''' shown in FIG. 9, the ribbon 20 is pulled on the opposite sides of the center of the curve with a force higher than that with which the center of the curve of the ribbon is pulled and thus, there is no possibility for occurrence of "crease" in the ribbon.

While one preferred embodiment of the invention has been shown and described in detail, it will be understood that the same is for illustration purpose only and not to be taken as a definition of the scope of the invention, which scope is defined by the appended claims.

What is claimed is:

1. A ribbon guide device for guiding a printing ribbon in a path of travel, the ribbon having a first surface for being contacted with a print head and a second surface for making contact with paper, comprising:

a pair of spaced apart inner guides facing each other and located on either side of the print head, each of said inner guides having a guide surface for making contact with the first surface of the ribbon;

a pair of spaced apart outer guides facing each other and located on either side outwardly of said pair of inner guides with the print head therebetween, each of said outer guides having a guide surface for making contact with the second surface of the ribbon;

each of said inner guides having means comprising a convex guide surface for transforming the second surface of the ribbon between said inner guides into convex form and means comprising a concave guide surface for transforming the second surface of the ribbon between each inner guide and its related outer guide into concave form; and each of said outer guides having a convex guide surface thereon.

2. A ribbon guide device according to claim 1, in which each of said outer guides has also a concave guide surface to transform the second surface of the ribbon into convex form.

3. A ribbon guide device according to claim 2, in which each of said convex guide surfaces of said inner guides has a radius of curvature R1 in a plane vertical to the ribbon path, and each of said concave guide surfaces of said outer guides has a radius of curvature R2 in a plane at right angles to the ribbon path.

4. A ribbon guide device according to claim 3, in which said radius of curvature R2 of said concave guide surfaces of the outer guides is slightly smaller than said radius of curvature R1 of said convex guide surfaces of the inner guides.

5. A ribbon guide device in a typing machine comprising;

a pair of outer guides;

a pair of inner guides positioned between said pair of outer guides;

a print head positioned between said pair of inner guides;

said pair of inner guides having means for transforming a section of ribbon between said pair of inner guides when disposed between said print head and a paper so that a longitudinal center line of said ribbon projects away from said print head; and said pair of inner guides and said pair of outer guides having means for transforming the section of ribbon between said inner guides and said outer guides so that a longitudinal center line of said ribbon projects toward said print head.

6. A ribbon guide device according to claim 5, wherein said pair of outer guides further comprises means for transforming a section of the ribbon outside of said outer guides so that a longitudinal center line of said ribbon projects toward said paper.

* * * * *